United States Patent [19]

Mar et al.

[11] 4,075,725

[45] Feb. 28, 1978

[54] SONOBUOY CASING

[75] Inventors: John Mar, Ottawa; Todd Garrett, Dartmouth; Petrus Jacques, Ottawa, all of Canada

[73] Assignee: Her Majesty the Queen in right of Canada, as represented by the Minister of National Defence, Ottawa, Canada

[21] Appl. No.: 689,492

[22] Filed: May 24, 1976

[30] Foreign Application Priority Data

Jun. 3, 1975 Canada ..... 228305

[51] Int. Cl.[2] ..... B63B 21/52

[52] U.S. Cl. ..... 9/8 R; 340/2

[58] Field of Search ..... 9/8 R, 9, 14; 244/138 R, 138 A; 116/124 B; 340/2, 3 R

[56] References Cited

U.S. PATENT DOCUMENTS

| | | | |
|---|---|---|---|
| 1,777,188 | 9/1930 | Wiley | 244/138 R |
| 3,006,002 | 10/1961 | Pingree et al. | 9/8 R |
| 3,047,259 | 7/1962 | Tatnall et al. | 244/138 A |
| 3,093,808 | 6/1963 | Tatnall et al. | 116/124 B |
| 3,561,705 | 2/1971 | Daughenbaugh | 9/8 R |

FOREIGN PATENT DOCUMENTS

| | | | |
|---|---|---|---|
| 1,263,761 | 11/1961 | France | 116/124 B |

*Primary Examiner*—Trygve M. Blix
*Assistant Examiner*—Jesus D. Sotelo

[57] ABSTRACT

A sonobuoy casing which comprises a split enclosure for a hydrophone, hinged at its base end. Upon deployment, the enclosure falls away, releasing the hydrophone to drop to its prescribed depth. A release mechanism which pushes the hydrophone out of its casing is thus dispensed with.

6 Claims, 6 Drawing Figures

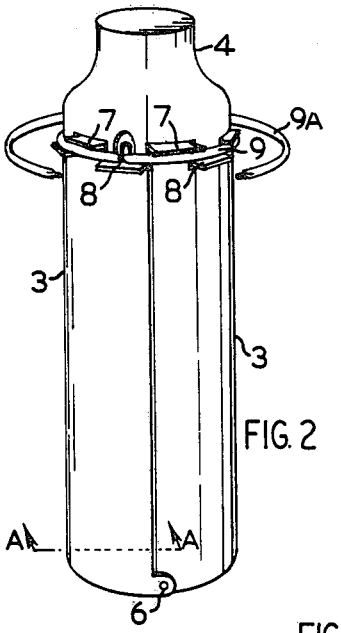
FIG. 2
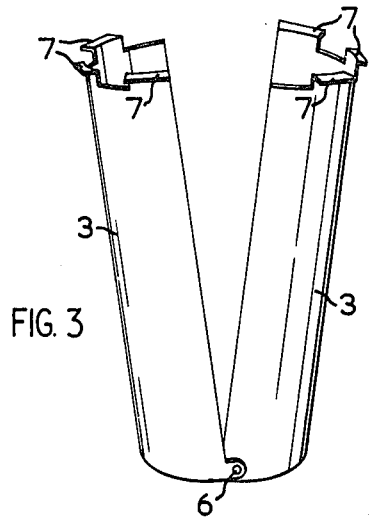
FIG. 3
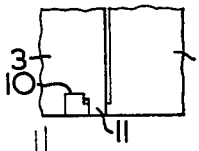
FIG. 4
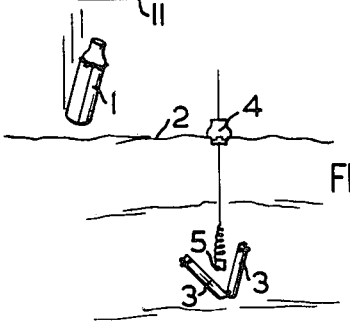
FIG. 1
FIG. 5A
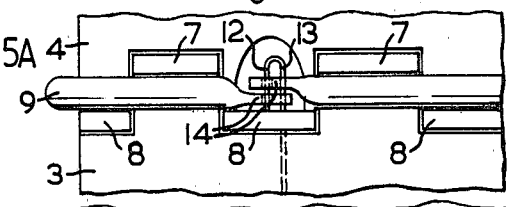
FIG. 5B
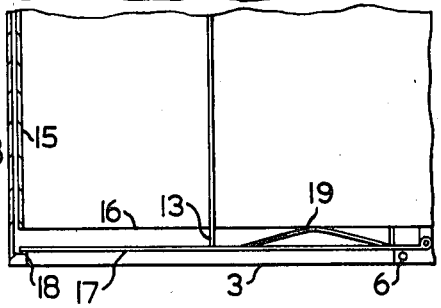

SONOBUOY CASING

This invention relates to a novel form of sonobuoy casing, and particularly to one which can be jettisoned using a minimum of ancillary equipment.

A sonobuoy is widely used for making measurements in a water environment of such things as acoustic pressure, temperature, etc. Usually the sonobuoy is comprised of an outer casing, within which is housed a transmitter, flotation gear, and means for dropping a sensor such as hydrophone to a predetermined depth. The hydrophone is connected via a cable to the transmitter maintained at the surface. The sonobuoy is usually ejected from an aeroplane flying overhead, or from a ship, and in both cases usually deployed in a manner such that impact occurs with the water. The impact triggers a release mechanism, causing the hydrophone and related apparatus to be ejected from the casing.

Structures used for releasing the hydrophone and related apparatus have been relatively complex, resulting in a high expense, or sometimes in a higher rate of non-deployment of the hydrophone than is necessary. Some structures make use of gravity to pull the hydrophone and related apparatus out of their housing upon impact, or a spring activated by the impact to push them out of the housing, or a piston driven by compressed gas to push them out, etc. The methods require ancillary equipment, or considerable clearance between the apparatus and the casing, both of which use up vital and limited space within the sonobuoy.

The present invention, on the other hand, has been found to be a highly reliable structure for deployment of the hydrophone, and costs very little more than the casing itself. In this invention, rather than removing the hydrophone and related apparatus from the casing, the casing itself is of a form which will open and fall away upon impact with the water, whereupon the apparatus can drop unimpeded to its prescribed depth. The novel casing is inexpensive and the preferred release mechanism is simple. Accordingly substantial advantage is obtained by its use.

The inventive sonobuoy casing is comprised of a disposable enclosure, the enclosure being formed of at least two portions in juxtaposition at edges extending longitudinally from both ends of the enclosure, the edges being located at opposed sides of the enclosure. While two portions of the enclosure can be used, there will be advantage in certain structures to use three or more.

In a narrower aspect of the invention, the sonobuoy casing comprises a pair of cylinder halves which meet at longitudinal edges extending from their two ends. Means is provided to hinge the halves together at each of the edges adjacent an end of the casing at the bottom of the sonobuoy. The hinging means need not necessarily be a hinge or a pin, as will be described later. Means is also provided for temporarily retaining the halves together at each of the edges adjacent the other end of the casing.

A better understanding of the invention will be obtained by reference to the description of the preferred embodiment below, as well as to the following drawings, in which:

FIG. 1 shows a sonobuoy falling to a body of water just prior to impact, and a sonobuoy just after impact with its split enclosure falling away, FIG. 2 is a perspective view of a sonobuoy with its enclosure intact, FIG. 3 is a perspective view of an open sonobuoy housing, FIG. 4 is a front elevation view of part of the enclosure showing a second type of hinge, FIG. 5A is a front elevation view of part of the casing showing a detail of a part of one form of enclosure release mechanism, and FIG. 5B is a sectional view taken along line A—A of FIG. 2 showing another detail of part of the form of enclosure release mechanism.

FIG. 1 depicts a sonobuoy just prior to entering the sea, and also one having its split enclosure falling free of the transmitter and floatation gear, allowing a reception element such as a hydrophone to drop to a prescribed depth.

A complete sonobuoy 1 is shown in FIG. 1 having been dropped into the water 2 from a ship or aeroplane. Once the sonobuoy has impacted the water, a bottom portion of the casing is caused to slide off, or the internal lower portion of the working parts of the sonobuoy are forced out, as by gravity, a spring, compressed air, or the like, as discussed earlier. However, in the present invention, a split disposable enclosure is utilized, shown in FIG. 1 as enclosure portions or cylinder halves 3. A mechanism to be described later causes release of the enclosure portions, allowing them to hinge at their lower end, open, and drop away through the water. An upper casing 4 contains a transmitter and floatation gear, and this remains at the surface. As the enclosure portions 3 fall away, a hydrophone or other sensing device which is attached by a long wire to the transmitter and other electronics of the upper casing is thus freed and drops to a prescribed depth which is predetermined prior to deployment.

It should be noted that while in the preferred embodiment described below an upper casing which houses the transmitter is retained at the surface of the water by floatation, it is contemplated that in many applications the entire casing will be split and no parts will be retained at the surface. In this situation the entire casing will fall through the water, and the transmitter and floatation gear which were previously housed within the split casing will be retained at the surface with no additional external protection.

It should also be noted that while in the described preferred embodiment the casing is split into two equal semi-cylindrical halves, the casing may be split into three or more portions, all of which will fall away similar to flower petals from the protected sonobuoy mechanism.

FIG. 2 shows a sonobuoy with a disposable enclosure according to the preferred embodiment. The enclosure portions 3 are located in juxtaposition or nearly thereto at edges extending longitudinally from both ends of the enclosure, on opposite sides of the enclosure. In the event three portions are used, each would subtend an arc of about 120 degrees, although this is not absolutely mandatory, so long as the opening of the enclosure portions can easily fall clear of the protected interior mechanism. Each enclosure portion should therefore preferably not subtend an angle of more than 180 degrees, for a cylindrical sonobuoy.

At the bottom and on both sides of the enclosure is hinge 6 which fastens the enclosure portions together.

In FIG. 3, the enclosure portions are shown after release, turning about hinge 6. It has been found that upon deployment and release of the other end of the enclosure portions, vibration, internal packaging pressures and gravity tend to open the released end of the enclosure portions, allowing them to simply fall away from the remainder of the sonobuoy.

The enclosure portion can have openings for access to various sonobuoy controls while in its protective configuration.

Turning back to FIG. 2, the upper end of the cylinder formed by the enclosure portions is castellated, the ends of the risers of the castellations being bent outward radially from the axis of the sonobuoy.

The bottom of upper casing 4 of the sonobuoy is formed into castellations which are of dimension and spacing such as to mate with the castellations 7 of the enclosure. The risers 8 of the castellations of the upper casing are similarly bent radially outward from the axis of the sonobuoy. It may be seen in FIG. 2, which shows the castellations in mating adjacency that a space is formed circumferentially between the outwardly extending portion of the risers of both sets of castellations, within which a stressed wire spring 9 is located. With the wire spring fixed between the castellation riser extensions, the entire assembly of the upper casing 4 and enclosure portions 3 are held together.

Upon release of spring 9 to its unstressed condition, shown as reference 9a, the mating configuration of the castellations are released, and they are allowed to slide past each other by vibration and gravity, whereupon the upper end of the enclosure portions swing outwardly about hinge 6, as shown in FIG. 3.

It should be noted that it is not necessary to provide a hinge 6 in order to make use of the invention, but merely to provide the function of a hinge during part of the unfolding process. FIG. 4 shows an alternative structure for fastening the enclosure portions together at their bottom end. Tabs 10 and 11 which are individual extensions of enclosure portions 3 contain cooperating slots which are fitted into each other. The slots perform a hinging function whereby the enclosure portions may be swung about each other. However, this structure has the additional facility of releasing the bottom ends of the enclosure portions from each other once they have swung out a certain distance, or in case there is differential longitudinal force between them. This structure may also be less costly than a pinned hinge structure. However, it may be desirable to utilize the pinned hinge structure where retention of the enclosure portions together during descent through the water is desired.

Turning now to FIG. 5a, the castellated mating portions of the upper casing 4 and one of the enclosure portions 3 is shown in enlarged detail. The radially extended ends of the risers 7 of the castellations of the lower enclosure portion are shown, as well as the radially extended ends of the risers 8 of the castellations of the upper casing. With the risers in mating configuration, wire spring 9 is shown in its stressed configuration therebetween, holding the entire assembly together as described earlier. The ends of wire 9 are flattened and overlapping, and a pin 12, at the end of a rod 13 is extended through coaxial holes 14 in the flattened portions of wire 9.

Upon movement of the rod 13 upward, pin 12 is removed from holes 14, allowing the spring 9 to suddenly increase its diameter to its unstressed position, removing itself from the channel formed by the riser 7 and 8 radial extensions. Thus the enclosure portion 3 can move out of mating configuration with upper casing 4, under the influence of vibration, gravity, and internal packaging pressures. Once the castellations are no longer interlocked, with nothing holding the upper ends of the enclosure portions together, they move apart, swinging about hinge 6 or tabs 10 and 11. Tabs 10 and 11 will move out of locking engagement, freeing the enclosure portions from each other.

FIG. 5*b* shows one structure for moving rod 13 upwardly to release the spring 9 and therefore the enclosure portions, and is a portion of the bottom of the sonobuoy in section, along line A—A of FIG. 2.

The enclosure portions 3 are shown attached together at hinge 6. A hydrophone or other internal mechanism 15 is housed within and close to the walls of the enclosure. Preferably a bottom plate 16 is located under the internal mechanism for the purpose of protection.

Hinged preferably from the bottom plate, but if desired from the enclosure portions is a pressure plate 17, retained against a stop 18 of one of the enclosure portions and biased thereagainst by a spring 19. Rod 13 bears against the upper portion of pressure plate 17.

Upon impact of the sonobuoy with water, sudden pressure will be placed upon pressure plate 17, causing it to swing about its hinge against spring 19, and moving it upwardly. Rod 13 will therefore be caused to move upwardly, releasing pin 12 from holes 14 of spring 9. Deployment of the sonobuoy and release of the enclosure portion is therefore caused upon impact with the water.

It should be noted that the described structure for retaining the entire assembly together can have numerous alternatives. Clearly the upper casing 4 will not be used in some applications, and consequently the castellations described earlier need not be used. For instance, one alternative structure is the attachment of a removable pin directly through two radial links from the tops of the two opposite enclosure portions which is released upon impact with water.

The enclosure portions can be easily designed to remain with the hydrophone until it reaches a prescribed depth, by well known pressure responsive sensors and mechanisms.

An impact deployment mechanism need not be used, and may be substituted by other means such as radio control, dissolution of a dissolvable or etched material upon contact with water, etc. A spring can be used to force the upper part of the enclosure portions apart, rather than reliance on vibration, internal packaging pressures and gravity. In some applications, the enclosure portions could usefully be hinged along one of their juxtaposed sides, springing open and clear of the hydrophone or other apparatus upon deployment, under the influence of a spring if desired.

It is also clear that there could be more than a single hydrophone within the enclosure. A group or system of hydrophones can be disposed for deployment in an array, after disposal of the enclosure portions.

As described earlier, more than two enclosure portions may be used, and other configurations than a cylindrical housing can be substituted for the one described.

Numerous alternatives will now be evident to one skilled in the art and are therefore intended to be within the scope of the present invention, within the ambit of the appended claims.

The embodiments of the invention in which an exclusive property or privilege is claimed and are defined as follows:

1. In a sonobuoy, a cylindrical casing comprising a. a plurality of longitudinal cylinder sections which meet at longitudinal edges extending upwardly from the bottom end of the cylinder, b. means hinging the sections together at each of said edges adjacent the bottom thereof at the bottom of the cylinder, c. means temporarily retaining the sections together at each of the other edges adjacent the other end of the casing, whereby upon release of said other edges, the bottom of each of the cylindrical sections can swing below the bottom and clear of the cylinder.

2. In a sonobuoy as defined in claim 1, means for removing said section retaining means whereupon the sections can be allowed to swing open about the hinging means.

3. In a sonobuoy as defined in claim 2, said other edges of the cylinder sections having castellations, the ends of the castellations extending outward radially from the cylinders, an upper cylindrical casing having a castellated edge in mating configuration with the castellations of said cylinder sections, the ends of the castellations of said edge extending outward radially from the casing, the remaining portion of the castellations being of sufficient length to accommodate an outwardly biased retaining spring between the radial extensions of the castellations of the cylinder sections and of the upper casings; further including means for releasably retaining the retaining spring in position between said radial extensions.

4. In a sonobuoy as defined in claim 3, a retaining spring of circular configuration having an unstressed diameter of dimension substantially larger than the diameter of the casing as measured between the extremities of said radial extensions of the castellations; the spring containing a hole at each of its ends, the spring being stressed and disposed in a channel created between said radial extensions, with its holes overlapping, the spring being of inside diameter when stressed about the same as the diameter of said channel; a pin extending through both of the annular openings for holding the spring in said stressed position, a rod connected to the pin extending through the cylinder to said bottom end, and an impact detector connected to the rod for moving the rod and releasing the pin, releasing and allowing the spring to widen to its unstressed diameter upon detection of an impact by said detector.

5. In a sonobuoy as defined in claim 2, a hydrophone and extension cable enclosed by said cylinder, a transmitter enclosed by an upper portion of said casing and means for releasing the sections from the sonobuoy, upon a predetermined water depth having been achieved.

6. In a sonobuoy as defined in claim 1, a hydrophone and extension cable enclosed by said cylinder.

* * * * *

UNITED STATES PATENT AND TRADEMARK OFFICE

CERTIFICATE OF CORRECTION

PATENT NO. : 4,075,725

DATED : February 28, 1978

INVENTOR(S) : John Mar et al

It is certified that error appears in the above-identified patent and that said Letters Patent are hereby corrected as shown below:

Column 5, line 9, insert --end-- between "bottom" and "thereof"

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*